US008758094B2

(12) United States Patent
Fischer

(10) Patent No.: US 8,758,094 B2
(45) Date of Patent: Jun. 24, 2014

(54) ADJUSTABLE BELT SANDER

(76) Inventor: Josef Fischer, Altheim (AT)

( * ) Notice: Subject to any disclaimer, the term of this patent is extended or adjusted under 35 U.S.C. 154(b) by 609 days.

(21) Appl. No.: 13/127,023

(22) PCT Filed: Oct. 27, 2009

(86) PCT No.: PCT/AT2009/000416

§ 371 (c)(1),
(2), (4) Date: Aug. 29, 2011

(87) PCT Pub. No.: WO2010/048651

PCT Pub. Date: May 6, 2010

(65) Prior Publication Data

US 2011/0306282 A1 Dec. 15, 2011

(30) Foreign Application Priority Data

Oct. 29, 2008 (AT) ..... A 1685/2008

(51) Int. Cl.
*B24B 21/00* (2006.01)

(52) U.S. Cl.
USPC ..... 451/303; 451/296; 451/168

(58) Field of Classification Search
CPC ..... B24B 9/18; B24B 21/002; B24B 21/16; B24B 27/0061
USPC ..... 451/168, 296, 302, 303, 305, 44
See application file for complete search history.

(56) References Cited

U.S. PATENT DOCUMENTS

| | | | | | |
|---|---|---|---|---|---|
| 294,766 | A * | 3/1884 | Coy | 451/303 |
| 832,114 | A * | 10/1906 | Wysong | 451/303 |
| 994,358 | A * | 6/1911 | Wysong | 451/303 |
| 1,493,779 | A * | 5/1924 | Humphreys | 451/303 |
| 2,296,990 | A * | 9/1942 | Fowler | 451/303 |
| 2,995,877 | A * | 8/1961 | Richmond | 451/492 |
| 3,524,284 | A * | 8/1970 | Mears | 451/303 |
| 3,715,839 | A * | 2/1973 | Heesemann | 451/168 |
| 4,084,356 | A * | 4/1978 | Brears | 451/59 |
| 4,694,614 | A * | 9/1987 | Shyang | 451/303 |
| 5,127,195 | A * | 7/1992 | Heesemann | 451/313 |
| 5,131,193 | A * | 7/1992 | Demers | 451/524 |
| 5,179,805 | A * | 1/1993 | Numao et al. | 451/312 |
| 7,261,622 | B2 * | 8/2007 | Hawkins | 451/344 |
| 8,210,905 | B2 * | 7/2012 | Sakairi | 451/44 |
| 8,540,551 | B2 * | 9/2013 | Brown et al. | 451/44 |
| 2003/0211818 | A1 * | 11/2003 | Kim | 451/296 |
| 2010/0112909 | A1 * | 5/2010 | Yamaguchi et al. | 451/44 |
| 2012/0156972 | A1 * | 6/2012 | Brown et al. | 451/44 |

FOREIGN PATENT DOCUMENTS

| | | | |
|---|---|---|---|
| AT | 413 958 | | 7/2006 |
| DE | 19921043 | A1 * | 11/2000 |
| EP | 00396 067 | | 11/1990 |
| EP | 0 406 989 | | 1/1991 |
| EP | 1050377 | A2 * | 11/2000 |
| WO | WO 2009/121084 | | 10/2009 |
| WO | WO 2009121084 | A1 * | 10/2009 |

* cited by examiner

*Primary Examiner* — Lee D Wilson
*Assistant Examiner* — Tyrone V Hall, Jr.
(74) *Attorney, Agent, or Firm* — Cozen O'Connor

(57) ABSTRACT

The invention relates to an adjustable belt sander, comprising a continuous sanding belt (11) and a sanding module (4), which supports the sanding belt in the sanding region and has a profiled guide surface which faces the sanding belt back and represents a rounding radius to be sanded, wherein the sanding module has a disk shape, is mounted centrally rotatably about a pivot pin (5) on a main body (3) arranged transversely to the sanding direction and at the peripheral profile has at least two quadrant circle contours having different radii, which determine the respective guide surface for the sanding belt.

5 Claims, 1 Drawing Sheet

ADJUSTABLE BELT SANDER

RELATED APPLICATIONS

This application is a U.S. National Phase Application under 35 USC 371 of International Application PCT/AT2009/000416, filed on 27 Oct. 2009.

This application claims the priority of Application No. A 1685/2008, filed 29 Oct. 2008, the content of which is incorporated here by reference.

FIELD OF THE INVENTION

The invention relates to an adjustable belt sander, having an endlessly revolving sanding belt, having a sanding module, bracing the sanding belt in the sanding region, which module has a profiled guide face, oriented toward the sanding belt back, which guide face represents a rounding radius to be sanded.

BACKGROUND OF THE INVENTION

Such devices for sanding rounded edges are suitable in general for postmachining circular segments on straight, rectangular workpieces, predominantly made of wood materials, such as stair steps, furniture elements, or the like, which can thus be sanded to improve their surfaces. This is predominantly done on machines with a conveyor device for feeding the linear workpieces and with a belt sanding assembly disposed on the conveyor. Suitably shaped tools of plastic, wood, metal, or composite materials are used. Tools of metal are also known that are each made for a particular radial dimension and through which during the sanding operation compressed air flows through bores made in them, thus reducing the friction between the sanding belt and the tool.

In these methods, in order to avoid sanding errors at the beginning and end of the workpiece, a device is required that makes it possible to insert the sanding shoe at the beginning of the workpiece and to lift it at the end of the workpiece, in both cases in an exact way. Replacing these individual tools to change the profile shape, and positioning them in the belt sanding assembly, require corresponding conversion times. A substantial disadvantage of the known belt sanding devices is also that the transitions between the rounding curves and the straight surfaces adjoining them cannot be sanded cleanly, so that postmachining by hand is usually required.

In order not to have to provide a separate sanding show for every possible profile shape, a continuously variably adjustable belt sanding device is known (Austrian Patent Disclosure AT 413 958 B) with laminations displaceable relative to one another, which adapt to a profiled surface by pressing against a corresponding pattern counter to the resistance of an elastic material and can be fixed in that position by firmly clamping the laminations. However, that operation has to be done anew each time a change is made to a different rounding radius.

A profile sanding assembly (European Patent Disclosure EP 0 396 067 A2) is also known that has a tool holder, described as a tool turret, in which various tools are embodied.

SUMMARY OF THE INVENTION

It is one object of the present invention to create a belt sander whose guide face for the sanding belt can be adjusted quickly and exactly, for a number of different radius dimensions, to a defined radius of a rounded edge to be sanded, so that the production of the profile replicated by the tool can be done perfectly; the transitions between the curved face and the adjoining flat faces are also to be sanded cleanly, and these adjustments are intended to be replicable at any time.

These objects are attained according to an embodiment of the invention by providing that the sanding module is disposed on the base body, where it is supported rotatably centrally about an axial bolt, and on its circumferential profile it has at least two quarter-circle contours with different radii, which determine the applicable guide face for the sanding belt.

In a refinement of the invention, it is provided that the sanding module has indexing bores, disposed in a circle, and by way of these bores the module can be fixed, by means of an indexing pin and a locking screw, in the position corresponding to the applicable rounding radius.

In another embodiment of the invention, two belt guide elements adjustable via set screws are disposed in the base body, guided between the sanding module and a cover plate, and they brace the sanding belt in the transition region from the rounding to the flat faces of a workpiece.

With these provisions, it is ensured that the guide face can be adjusted in a desired way, such that it corresponds precisely to the negative of a rounding shape to be completed.

To reduce the friction, caused by the rapidly revolving sanding belt, between the guide face of the disklike sanding module and both the belt guide cheeks and the back of the sanding belt, it is expedient if according to an embodiment of the invention, between the sanding module and the belt guide elements on the one hand and the sanding belt on the other, a lubricant lining is provided. For instance, a lubricant coating which comprises a textile substrate material with an applied graphite film and which is cut to length accordingly can be applied whose thickness, like that of the sanding belt, must be taken into account in the embodiment of the rounding profiles.

Mounting the belt sander of the invention on a belt sanding assembly provided for the sanding operation proves to be simple because the belt sander is fixedly screwed to the machine, preferably via a connecting part to be mounted on the base body between the sanding belt deflection rollers, in such a way that the center axis of the belt sanding device oriented longitudinally of the workpiece conveyor direction is at an angle of 45° and at a corresponding spacing from the workpiece edge.

BRIEF DESCRIPTION OF THE DRAWINGS

One exemplary embodiment of the invention will be described below in further detail in conjunction with the drawings. In the drawings.

DETAILED DESCRIPTION OF THE DRAWINGS

Figure 1:
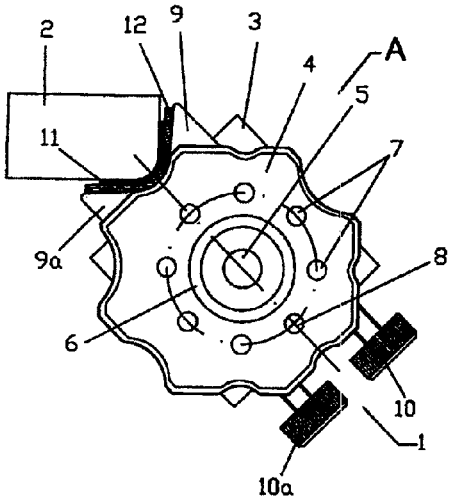
FIG. 1 is a side view of a belt sander according to the invention.
Figure 2:
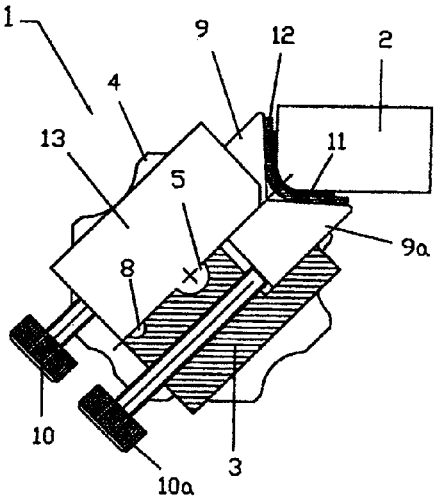
FIG. 2 is a fragmentary sectional view of the belt sanding device taken along the line II-II in FIG. 3.

A belt sander 1 according to the invention, with a revolving sanding belt 11, includes a base body 3, which has a disklike sanding module 4 supported rotatably on a fixed axial bolt 5; in the example shown, the circumferential contour of the module has eight different symmetrically disposed contours of quarter-circular shape that form the guide faces for bracing the sanding belt 11 together with the belt guide elements 9 and 9*a*, which elements are guided in the base body 3 between the profile disk 4 and the cover plate 13 and are adjustable with the aid of set screws 10 and 10*a*; between the guide elements, there is a lubricant coating 12 in the sanding region on one possible workpiece 2.

The particular adjustment that is valid at a particular time is defined exactly, and can thus be fixed by means of a locking screw 6, by means of an indexing pin 8 that protrudes from the base body 3 and engages one of the indexing bores 7 that are disposed in a circle in the sanding module 4.

The adjustment to a different rounding contour or a different rounding radius is done by loosening the locking screw 6, pulling the sanding module 4 on the axial bolt 5 out of the engagement range of the indexing pin 8, and correspondingly rotating and fixing it in the desired position. Once the locking screw 6 is removed, the profile disk 4 can also be replaced by a sanding module with different rounding contours or rounding radii, or by an individual segment for special rounding contours.

Figure 3:
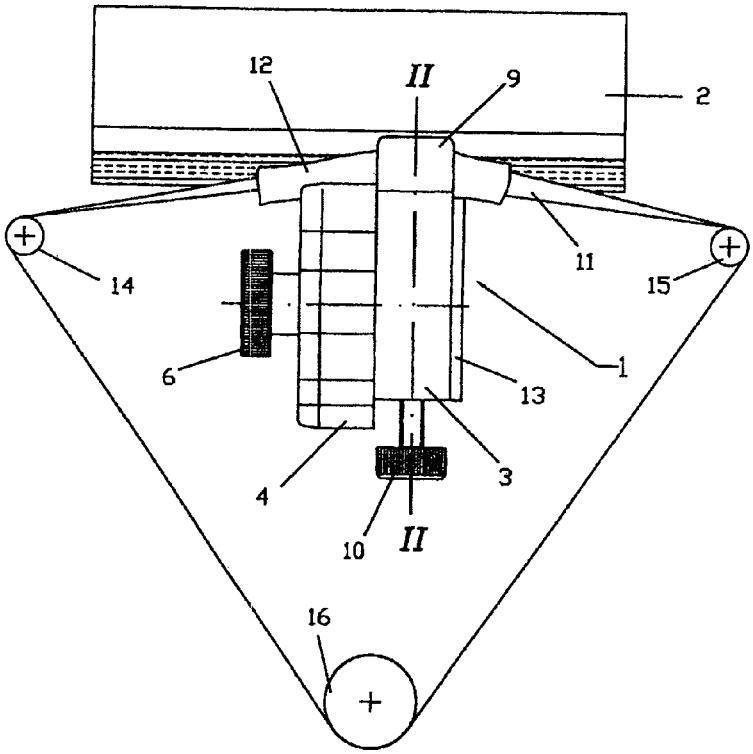
FIG. 3 shows the belt sander in the top view A in FIG. 1 on a sanding assembly that is represented symbolically.

FIG. 3, in the top view A of FIG. 1, schematically shows the possible installation arrangement of a belt sander 1 of the invention in a sanding assembly represented symbolically by the sanding belt rollers 14, 15 and 16 as well as a revolving sanding belt 11; a sanding operation is being performed on a workpiece 2 that is being guided along the sanding assembly.

It is understood that the exemplary embodiment described can be modified in various ways within the scope of the concept of the invention, in particular with regard to the embodiment of the sanding module and its circumferential contours.

The invention claimed is:

1. An adjustable belt sander, comprising an endlessly revolving sanding belt and a sanding module bracing the sanding belt in the sanding region, which module has a profiled guide face oriented toward the sanding belt back, which guide face represents a rounding radius to be sanded, and the sanding module is embodied in disklike fashion and is rotatably supported on a base body disposed transversely to the sanding direction, wherein the sanding module is disposed rotatably supported on the base body centrally around an axial bolt and on its circumferential profile has at least two quarter-circle contours with different radii, which determine the applicable guide face for the sanding belt.

2. The adjustable belt sander as defined by claim 1, wherein the sanding module has indexing bores, disposed in a circle, by way of which bores it is fixable, by means of an indexing pin and a locking screw, in the position corresponding to the applicable rounding radius.

3. The adjustable belt sander as defined by claim 1, wherein two belt guide elements, adjustable via set screws, are disposed in the base body, are guided between the sanding module and a cover plate, and brace the sanding belt in the transition region from the rounding to the flat faces of a workpiece.

4. The adjustable belt sander as defined by claim 3, wherein a lubricant coating is provided between the sanding module and the belt guide elements on the one hand and the sanding belt on the other.

5. The adjustable belt sander as defined by claim 2, wherein the base body, with the axial bolt and the locking screw, is embodied such that the sanding module can be exchanged for sanding modules with different rounding radii.

* * * * *